US006851287B1

(12) United States Patent
Yang et al.

(10) Patent No.: US 6,851,287 B1
(45) Date of Patent: Feb. 8, 2005

(54) LOCK HAVING A QUICK UNLOCKING FUNCTION

(76) Inventors: Zhen-Lin Yang, 58, Ma Yuan West St., Taichung (TW); Sheng-Jan Yang, 58, Ma Yuan West St., Taichung (TW); Mu-Gui Yang, 58, Ma Yuan West St., Taichung (TW)

( * ) Notice: Subject to any disclaimer, the term of this patent is extended or adjusted under 35 U.S.C. 154(b) by 0 days.

(21) Appl. No.: 10/803,728

(22) Filed: Mar. 16, 2004

(51) Int. Cl.[7] ..... E05B 59/00; E05B 63/14

(52) U.S. Cl. ..... 70/107; 70/134; 70/352; 292/36; 292/179; 292/150; 292/333

(58) Field of Search ..... 70/107–111, 150, 70/151 R, 151 A, 134, 467–482, 141, DIG. 6, 352–355; 292/35, 36, 150, 179, 333

(56) References Cited

U.S. PATENT DOCUMENTS 1,721,676 A * 7/1929 Thelenz ..... 70/110
5,027,625 A * 7/1991 Krachten ..... 70/107
5,267,457 A * 12/1993 Sorensen et al. ..... 70/130
5,421,074 A * 6/1995 Moore ..... 29/401.1
5,469,723 A * 11/1995 Litwin et al. ..... 70/107
5,950,467 A * 9/1999 Dong ..... 70/467
6,302,456 B1 * 10/2001 Errani ..... 292/332
6,651,466 B1 * 11/2003 Shih ..... 70/107
6,684,669 B1 * 2/2004 Talpe ..... 70/107

* cited by examiner

*Primary Examiner*—Lloyd A. Gall
(74) *Attorney, Agent, or Firm*—Alan D. Kamrath; Nikolai & Mersereau, P.A.

(57) ABSTRACT

A lock includes a quick unlocking device and a secondary locking device. Thus, when the inner handle is rotated, the latch bolt and the dead bolt are unlocked synchronously by operation of the quick unlocking device, so that the door plate can be opened rapidly, thereby facilitating the user opening the door during the emergency condition. In addition, when the locking block is pressed inward, the locking stud of the locking block is locked in the locking hole of the locking seat to lock the control knob on the locking seat without rotation, such that the dead bolt is fixed by the control knob, thereby forming a secondary locking effect to achieve the anti-theft purpose.

20 Claims, 8 Drawing Sheets

LOCK HAVING A QUICK UNLOCKING FUNCTION

BACKGROUND OF THE INVENTION

1. Field of the Invention

The present invention relates to a lock, and more particularly to a lock having a quick unlocking function.

2. Description of the Related Art

A conventional lock comprises a locking seat mounted on a door plate, a face plate mounted on an end of the door plate, a dead bolt retractably mounted on the face plate, a drive member mounted on the locking seat and connected to the dead bolt to control movement of the dead bolt, and a control knob mounted on an inner side of the door plate and connected to the dead bolt to control movement of the dead bolt. Thus, a user can insert a key into a key hole of the locking seat to move the drive member of the locking seat to drive the dead bolt to retract into the face plate, thereby unlocking the dead bolt, so that the user can open the door outside. Alternatively, the user can also rotate the control knob to drive the dead bolt to retract into the face plate, thereby unlocking the dead bolt, so that the user can open the door inside. The conventional lock further comprises a latch bolt retractably mounted on the face plate, and an inner handle mounted on the inner side of the door plate to control movement of the latch bolt.

However, the user needs to rotate the control knob to unlock the dead bolt and then rotate the inner handle to unlock the latch bolt so as to open the door, thereby causing convenience to the user during the emergency condition.

SUMMARY OF THE INVENTION

The primary objective of the present invention is to provide a lock having a quick unlocking function.

Another objective of the present invention is to provide a lock having a secondary locking function.

A further objective of the present invention is to provide a lock, wherein when the inner handle is rotated, the latch bolt and the dead bolt are unlocked synchronously by operation of the quick unlocking device, so that the door plate can be opened rapidly, thereby facilitating the user opening the door during the emergency condition.

A further objective of the present invention is to provide a lock, wherein when the locking block is pressed inward, the locking stud of the locking block is locked in the locking hole of the locking seat to lock the control knob on the locking seat without rotation, such that the dead bolt is fixed by the control knob, thereby forming a secondary locking effect to achieve the anti-theft purpose.

In accordance with one embodiment of the present invention, there is provided a lock, comprising a quick unlocking device including:

a frame;

a face plate mounted on a side of the frame;

a drive shaft movably mounted in the frame;

a latch bolt retractably mounted on the face plate and secured on a first end of the drive shaft to move therewith;

a multi-stage dead bolt movably mounted in the frame and having a first end retractably mounted on the face plate and a second end having a first side formed with a plurality of arcuate locking grooves;

a locking plate movably mounted in the frame and having an end formed with a locking block detachably locked in either one of the locking grooves of the dead bolt to lock the dead bolt;

an inner crank pivotally mounted on the frame and having a first section secured on a second end of the drive shaft for moving the drive shaft and a second section formed with a pivot plate; and a hook plate movably mounted in the frame and having a first end pivotally mounted on the pivot plate of the inner crank and a second end formed with a hook portion located adjacent to the locking block of the locking plate, so that the hook portion of the hook plate is movable to urge and move the locking block of the locking plate to detach from the locking grooves of the dead bolt so as to release the dead bolt, such that the dead bolt is movable.

In accordance with another embodiment of the present invention, there is provided a lock, comprising a secondary locking device including:

a locking seat having an end formed with a locking hole;

a control knob rotatably mounted on the locking seat to control movement of the dead bolt and having an end formed with a slide seat that is rotatable with the control knob to align with the locking hole of the locking seat; and a locking block movably mounted on the slide seat of the control knob and having a hollow inside formed with a protruding locking stud detachably locked in the locking hole of the locking seat to lock the control knob on the locking seat.

Further benefits and advantages of the present invention will become apparent after a careful reading of the detailed description with appropriate reference to the accompanying drawings.

DETAILED DESCRIPTION OF THE INVENTION

Figure 1:
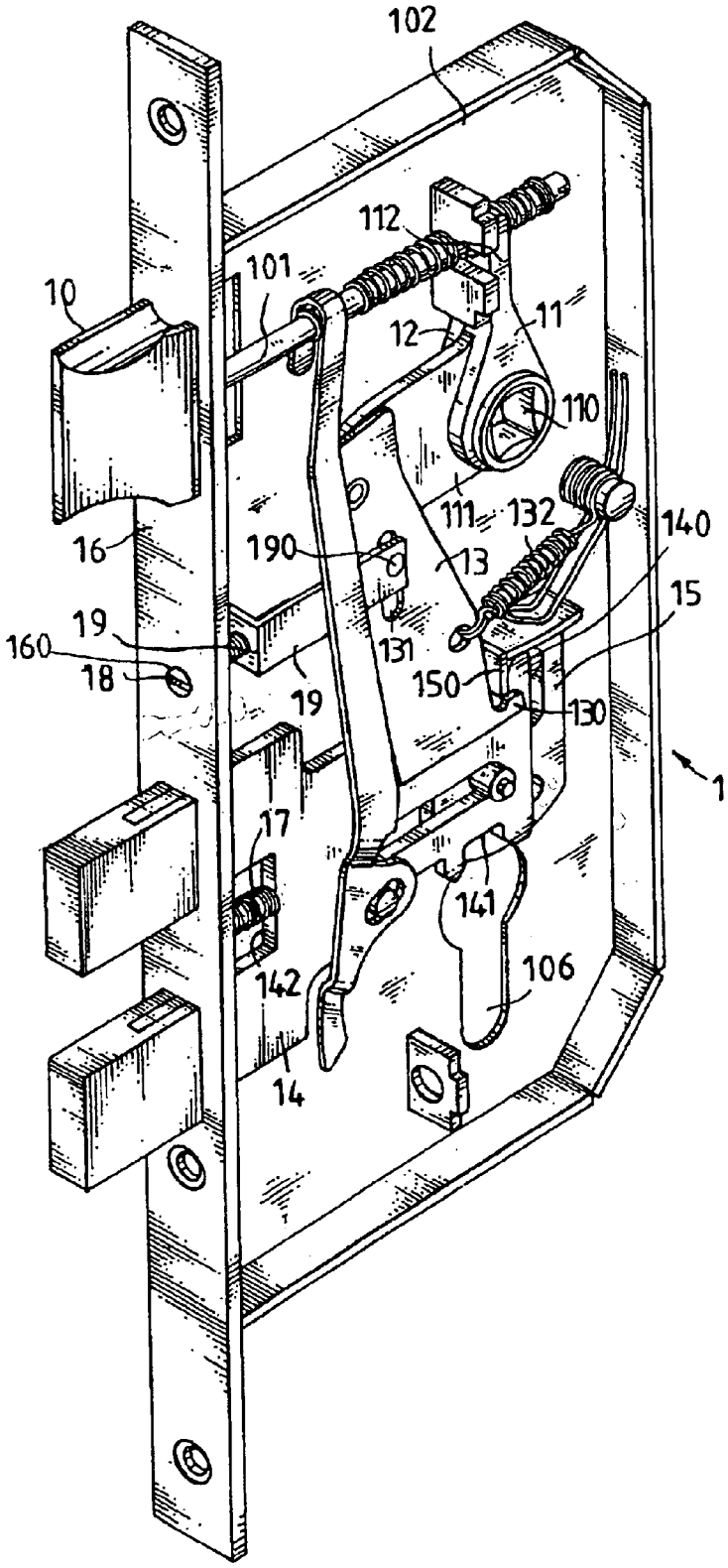
FIG. 1 is a perspective view of a quick unlocking device of a lock in accordance with the preferred embodiment of the present invention.
Figure 6:
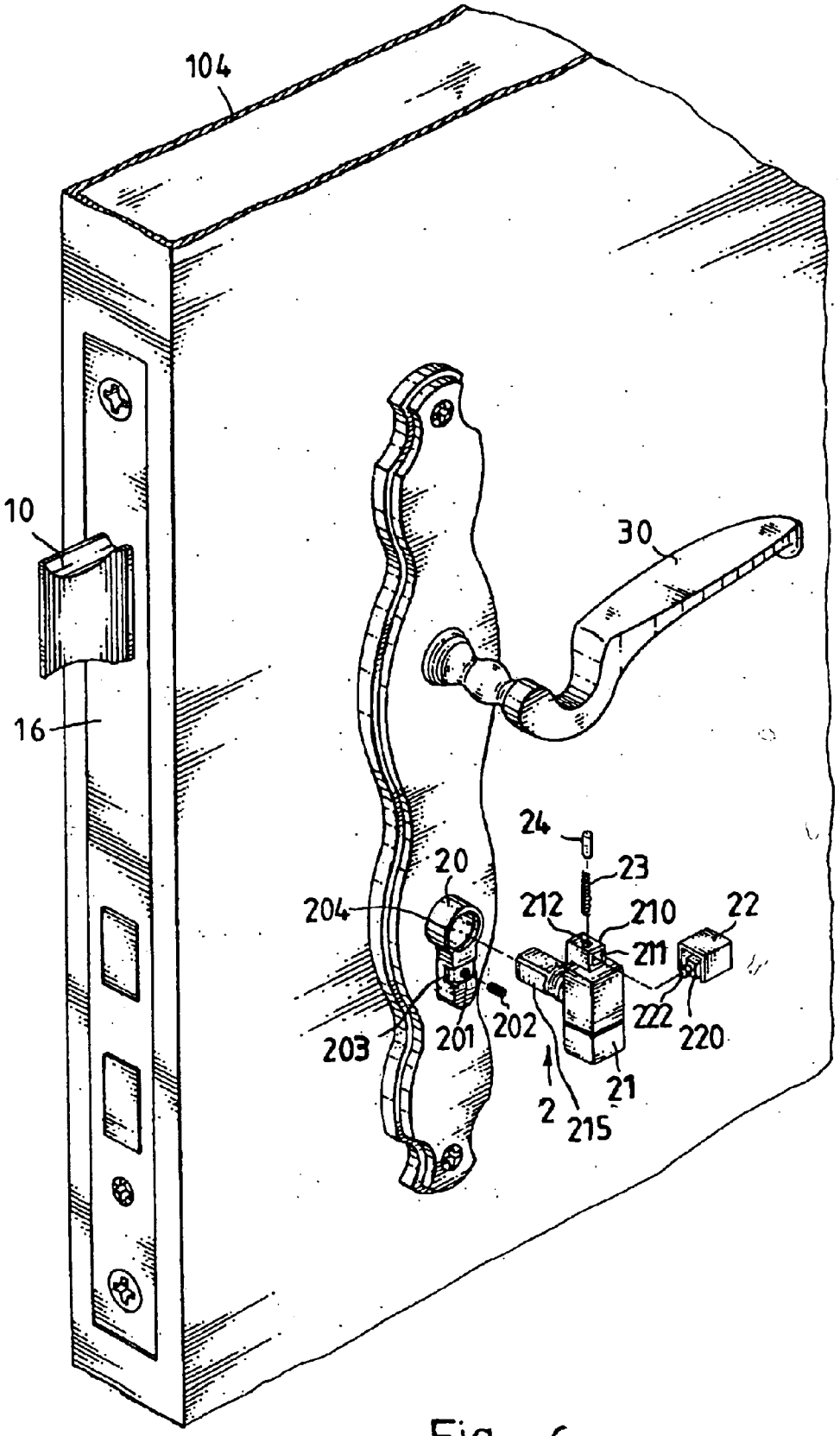
FIG. 6 is a partially cut-away exploded perspective view of a secondary locking device of the lock in accordance with the preferred embodiment of the present invention.
Figure 7:
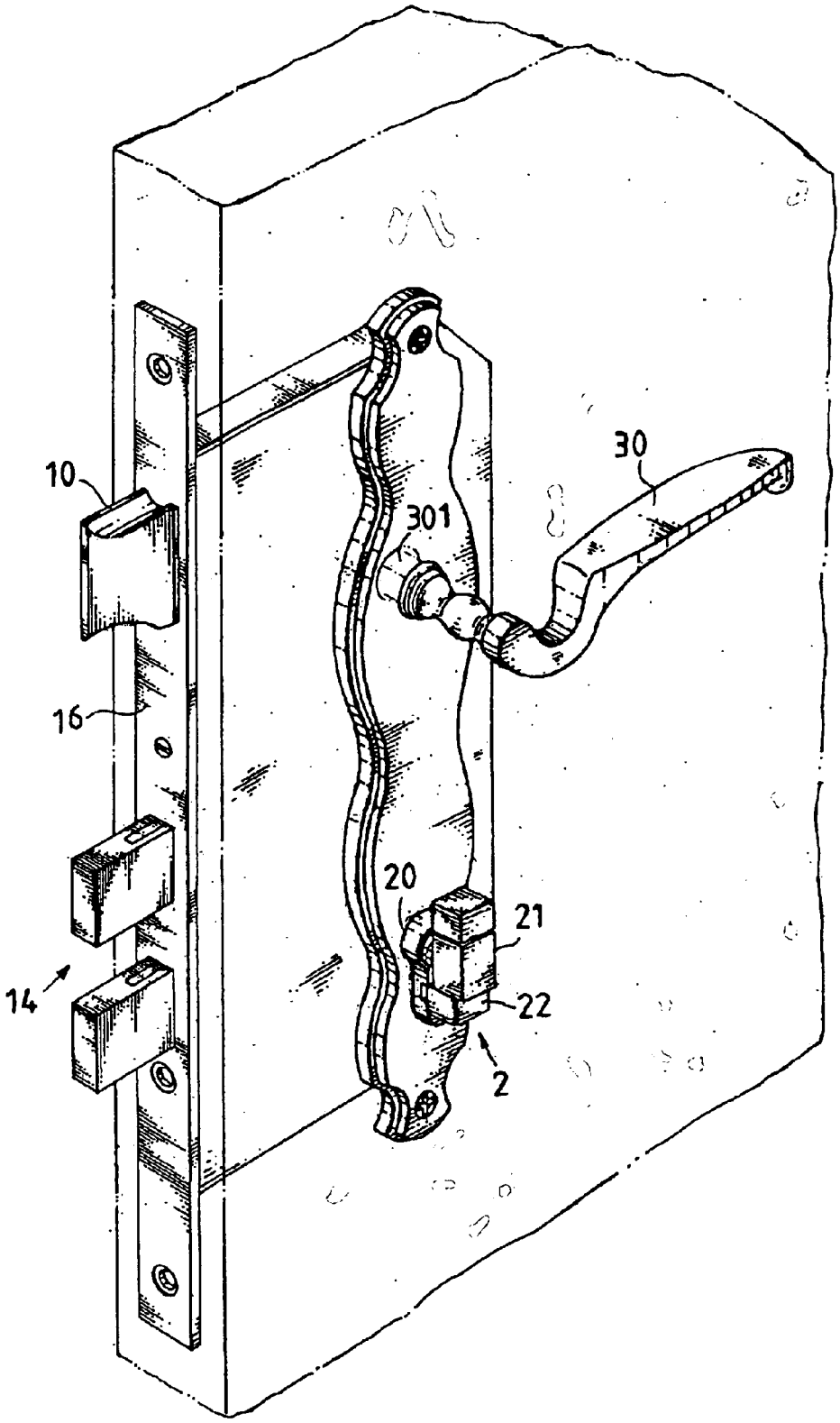
FIG. 7 is a partially cut-away perspective assembly operational view of the secondary locking device as shown in FIG. 6.

Referring to the drawings and initially to FIGS. 1 and 6, a lock in accordance with the preferred embodiment of the present invention comprises a quick unlocking device 1 and a secondary locking device 2.

As shown in FIGS. 1–4, the quick unlocking device 1 includes a door plate 104 (see FIG. 6), a frame 102 mounted in the door plate 104, a face plate 16 mounted on a side of the frame 102, a drive shaft 101 movably mounted in the frame 102, a latch bolt 10 retractably mounted on the face plate 16 and secured on a first end of the drive shaft 101 to move therewith, a multi-stage dead bolt 14 movably mounted in the frame 102 and having a first end retractably mounted on the face plate 16 and a second end having a first side formed with a plurality of arcuate locking grooves 140, a locking plate 15 movably mounted in the frame 102 and having an end formed with a locking block 150 detachably locked in either one of the locking grooves 140 of the dead bolt 14 to lock the dead bolt 14, an inner crank 11 pivotally mounted on the frame 102 and having a first section 112 secured on a second end of the drive shaft 101 for moving the drive shaft 101 and a second section formed with a pivot plate 111, and a hook plate 13 movably mounted in the frame 102 and having a first end pivotally mounted on the pivot plate 111 of the inner crank 11 and a second end formed with a hook portion 130 located adjacent to the locking block 150 of the locking plate 15, so that the hook portion 130 of the hook plate 13 is movable to urge and move the locking block 150 of the locking plate 15 to detach from the locking grooves 140 of the dead bolt 14 so as to release the dead bolt 14, such that the dead bolt 14 is movable.

The inner crank 11 is substantially L-shaped and has a mediate section formed with a square hole 110, and the quick unlocking device 1 further includes an inner handle 30 (see FIG. 6) pivotally mounted on the door plate 104 and having a square spindle 301 secured in the square hole 110 of the inner crank 11 for rotating the inner crank 11, so that the inner crank 11 is pivoted by rotation of the inner handle 30 so as to move the drive shaft 101.

The quick unlocking device 1 further includes an outer crank 12 pivotally mounted on the frame 102 and having a first section secured on the second end of the drive shaft 101 for moving the drive shaft 101, and an outer handle (not shown) pivotally mounted on the door plate 104 and having an end secured on a second section of the outer crank 12 for rotating the outer crank 12, so that the outer crank 12 is pivoted by rotation of the outer handle so as to move the drive shaft 101.

Figure 3:
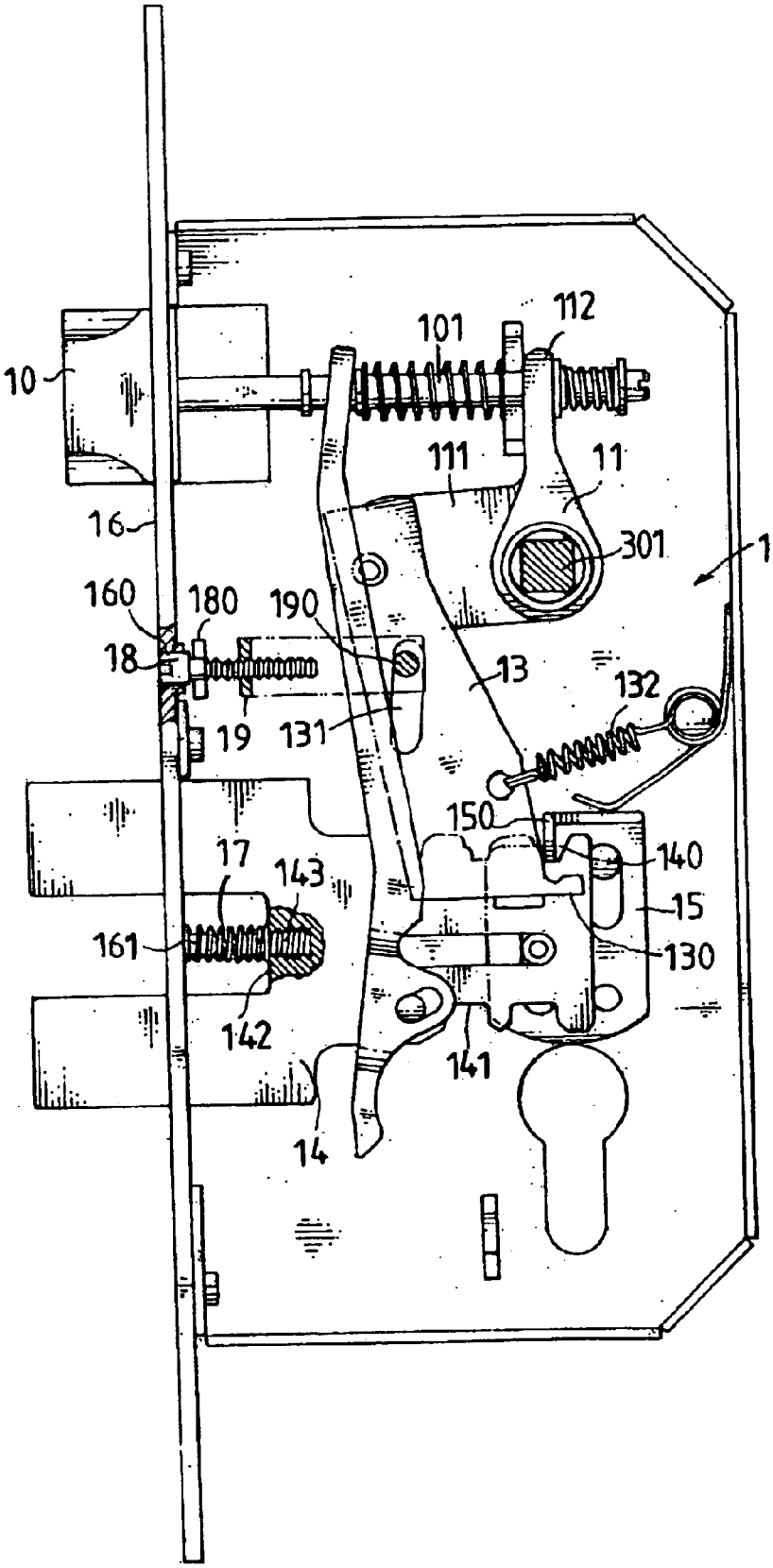
FIG. 3 is a front plan view of the quick unlocking device as shown in FIG. 1.

The quick unlocking device 1 further includes a tensile spring 132 having a first end secured on the frame 102 and a second end secured on the second end of the hook plate 13, so that the hook portion 130 of the hook plate 13 is normally located under the locking block 150 of the locking plate 15 by the elastic force of the tensile spring 132 as shown in FIG. 3.

The first end of the dead bolt 14 is substantially U-shaped, and a compression spring 17 is urged between the first end of the dead bolt 14 and the face plate 16 to push the dead bolt 14 to move toward the locking plate 15 to retract into the face plate 16. Preferably, the first end of the dead bolt 14 has a mediate portion 142 formed with a positioning post 143 for mounting a first end of the compression spring 17, and the face plate 16 is formed with a positioning post 161 for mounting a second end of the compression spring 17. The second end of the dead bolt 14 has a second side formed with a toothed slot 141 located above a key hole 106 formed in the frame 102.

Figure 2:
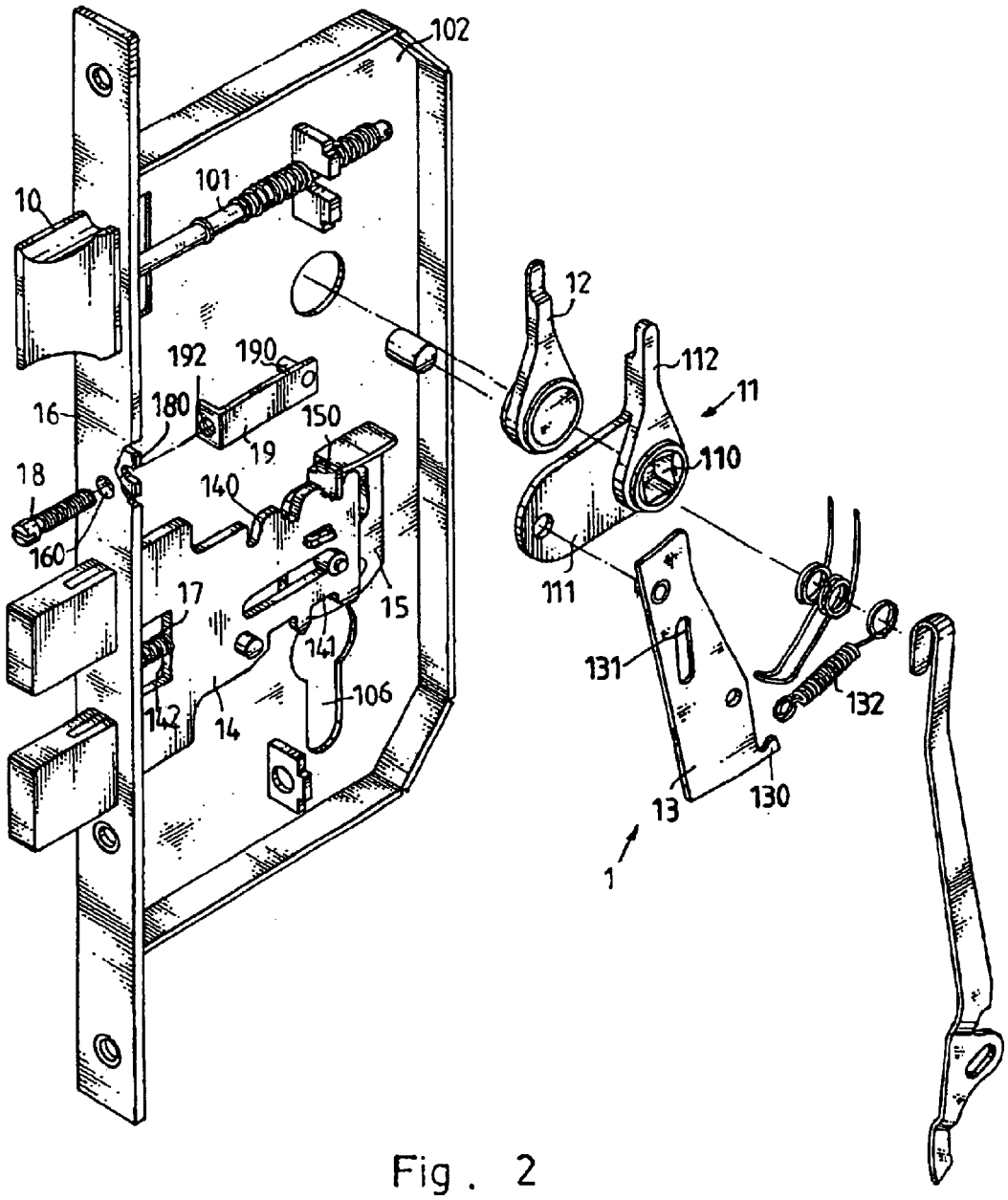
FIG. 2 is a partially exploded perspective view of the quick unlocking device as shown in FIG. 1.
Figure 4:
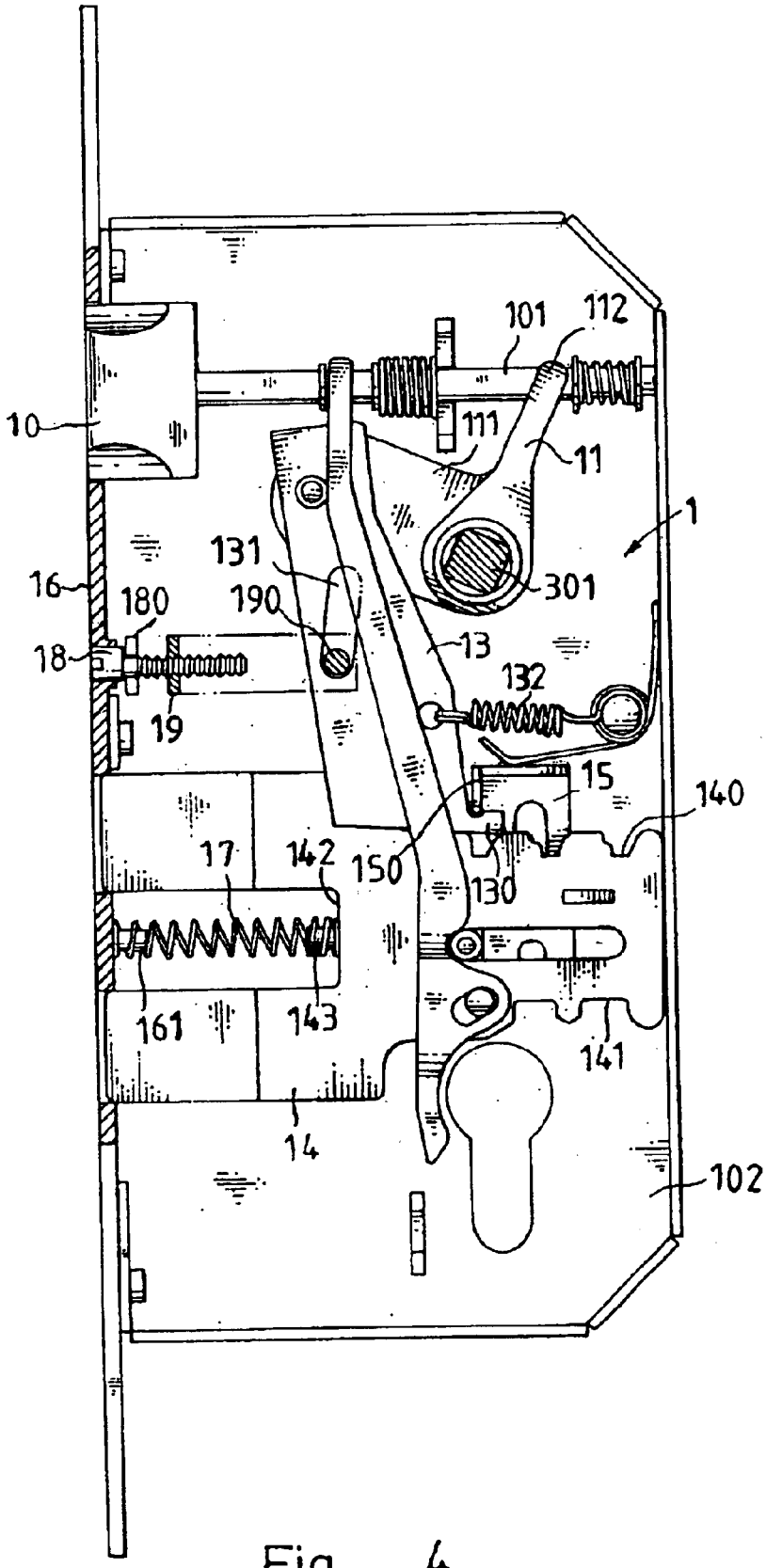
FIG. 4 is a schematic operational view of the quick unlocking device as shown in FIG. 3.

In operation, referring to FIGS. 3 and 4 with reference to FIGS. 1 and 2, when the inner handle 30 is rotated, the spindle 301 of the inner handle 30 drives the inner crank 11 to rotate clockwise as shown in FIG. 4, so that the hook plate 13 is moved upward by the pivot plate 11 of the inner crank 11. In such a manner, the hook portion 130 of the hook plate 13 is moved upward to urge and move the locking block 150 of the locking plate 15 to detach from the locking grooves 140 of the dead bolt 14 so as to release the dead bolt 14, such that the dead bolt 14 is movable. Thus, the dead bolt 14 is pushed by the restoring force of the compression spring 17 to move from the position as shown in FIG. 3 to the position as shown in FIG. 4 to retract into the face plate 16, thereby unlocking the dead bolt 14.

At the same time, when the inner crank 11 is pivoted clockwise by rotation of the inner handle 30, the drive shaft 101 is moved by pivot of the inner crank 11, so that the latch bolt 10 is moved by the drive shaft 101 to retract into the face plate 16, thereby unlocking the latch bolt 10.

Accordingly, when the inner handle 30 is rotated, the latch bolt 10 and the dead bolt 14 are unlocked synchronously by operation of the quick unlocking device 1, so that the door plate 104 can be opened rapidly, thereby facilitating the user opening the door during the emergency condition.

As shown in FIGS. 1–3, the hook plate 13 has a mediate portion formed with a guide slot 131, and the quick unlocking device 1 further includes a drive plate 19 movably mounted in the frame 102 and having a first end formed with a hook post 190 slidably mounted in the guide slot 131 of the hook plate 13 and a second end formed with a screw bore 192, an adjusting bolt 18 rotatably mounted on the face plate 16 and screwed into the screw bore 192 of the drive plate 19, and a positioning plate 180 secured on the frame 102 for retaining the adjusting bolt 18. Preferably, the face plate 16 is formed with a through hole 160 for receiving the adjusting bolt 18.

Figure 5:
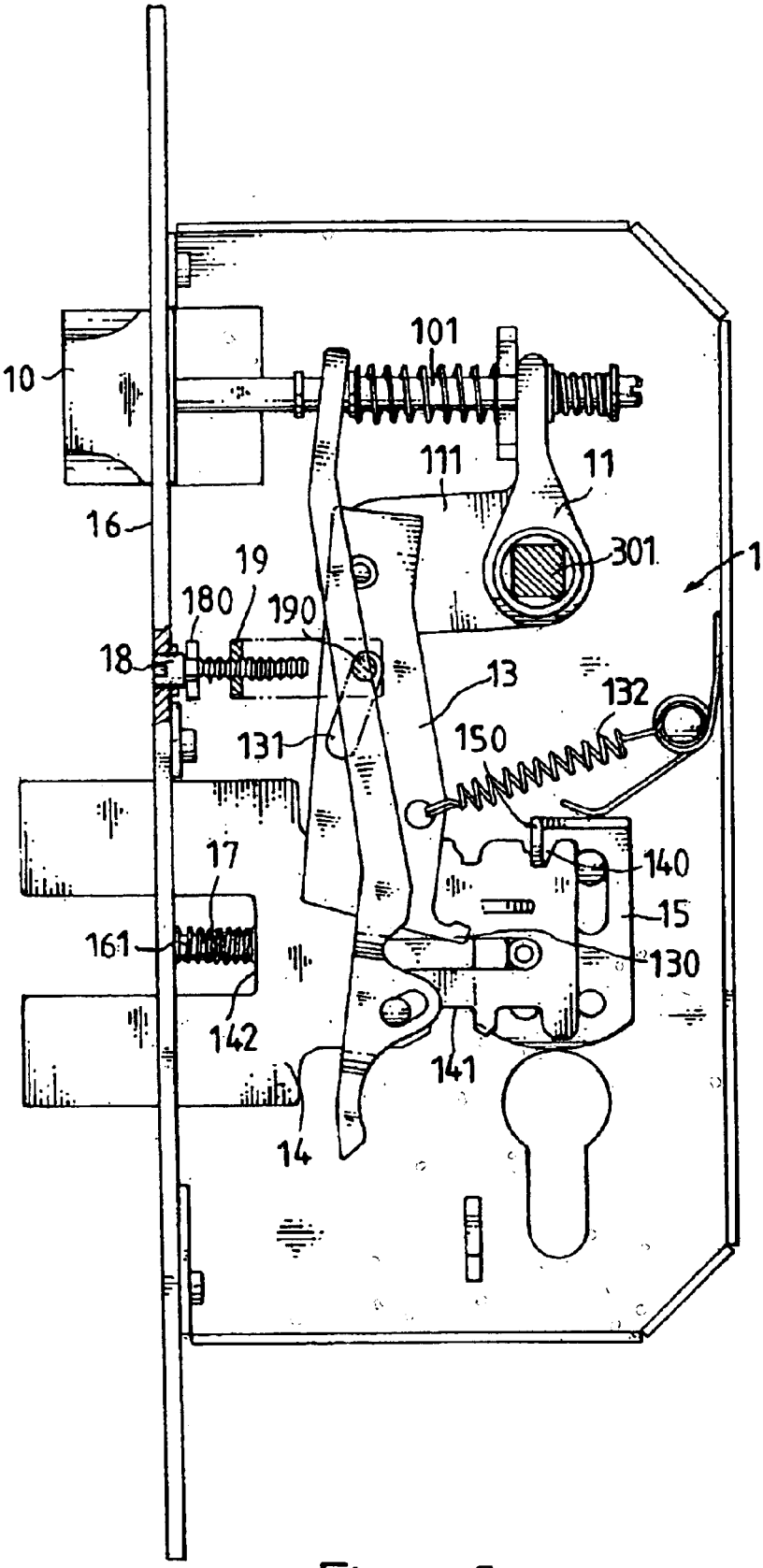
FIG. 5 is a schematic operational view of the quick unlocking device as shown in FIG. 4.

As shown in FIG. 5, the adjusting bolt 19 is rotated to move the drive plate 19 which moves the hook post 190 which moves the hook plate 13 so as to move the hook portion 130 of the hook plate 13 away from the locking block 150 of the locking plate 15 such that the dead bolt 14 is returned to the original position.

As shown in FIGS. 6–9, the secondary locking device 2 includes a locking seat 20 mounted on the door plate 104 and having a first end formed with a mounting hole 204 and a second end formed with a threaded locking hole 201, a control knob 21 rotatably mounted on the locking seat 20 and having an end formed with a slide seat 210 that is rotatable with the control knob 21 to align with the locking hole 201 of the locking seat 20, and a locking block 22 movably mounted on the slide seat 210 of the control knob 21 and having a hollow inside formed with a protruding locking stud 220 detachably locked in the locking hole 201 of the locking seat 20 to lock the control knob 21 on the locking seat 20.

The slide seat 210 of the control knob 21 has a hollow inside formed with an axially extended rectangular insertion hole 211 for insertion of the locking stud 220 of the locking block 22, and the locking stud 220 of the locking block 22 is substantially rectangular and has a distal end formed with a cylindrical head 222 detachably locked in the locking hole 201 of the locking seat 20.

Figure 8:
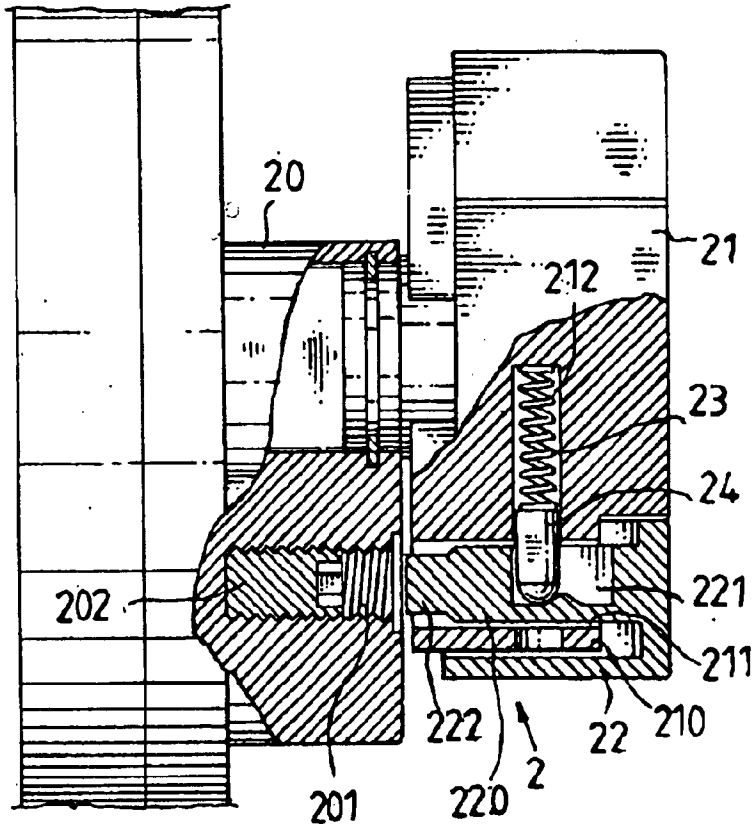
FIG. 8 is a side plan partially cross-sectional assembly of the secondary locking device as shown in FIG. 6.

The locking stud 220 of the locking block 22 has a side formed with two spaced retaining grooves 221, the slide seat 210 of the control knob 21 has a periphery formed with a radially extended receiving recess 212 extended into the control knob 21 as shown in FIG. 8 and communicating with the insertion hole 211, and the secondary locking device 2 further includes a positioning stub 24 movably mounted in the receiving recess 212 of the control knob 21 and detachably locked in either one of the two spaced retaining grooves 221 of the locking stud 220 of the locking block 22 to position the locking block 22, and a spring 23 mounted in the receiving recess 212 of the control knob 21 and urged on the positioning stub 24 to move toward the locking stud 220 of the locking block 22.

The control knob 21 has a mediate portion formed with a protruding control member 215 extended through the mounting hole 204 of the locking seat 20 and connected to the dead bolt 14, so that when the control knob 21 is rotated, the dead bolt 14 is moved by rotation of the control knob 21, and when the control knob 21 is fixed, the dead bolt 14 is fixed by the control member 215 of the control knob 21 without movement.

In addition, a drive member (not shown) is mounted on the locking seat 20, rested on the bottom of the locking plate 15 and connected to the dead bolt 14. When a key (not shown) is inserted into the key hole 106 as shown in FIGS. 1 and 2, the drive member of the locking seat 20 is driven by the key to push the locking plate 15 upward to move the locking block 150 of the locking plate 15 to detach from the locking grooves 140 of the dead bolt 14 so as to release the dead bolt 14, such that the dead bolt 14 is movable. Thus, the drive member of the locking seat 20 drives the toothed slot 141 of the dead bolt 14 to move the dead bolt 14, so that the dead bolt 14 is moved freely by movement of the drive member of the locking seat 20.

Alternatively, when the control knob 21 is fixed, the dead bolt 14 is fixed by the control member 215 of the control knob 21 without movement, and the drive member of the locking seat 20 is fixed by the dead bolt 14, so that the dead bolt 14 cannot be moved by the key from the outside of the door, thereby achieving the anti-theft purpose.

Figure 9:
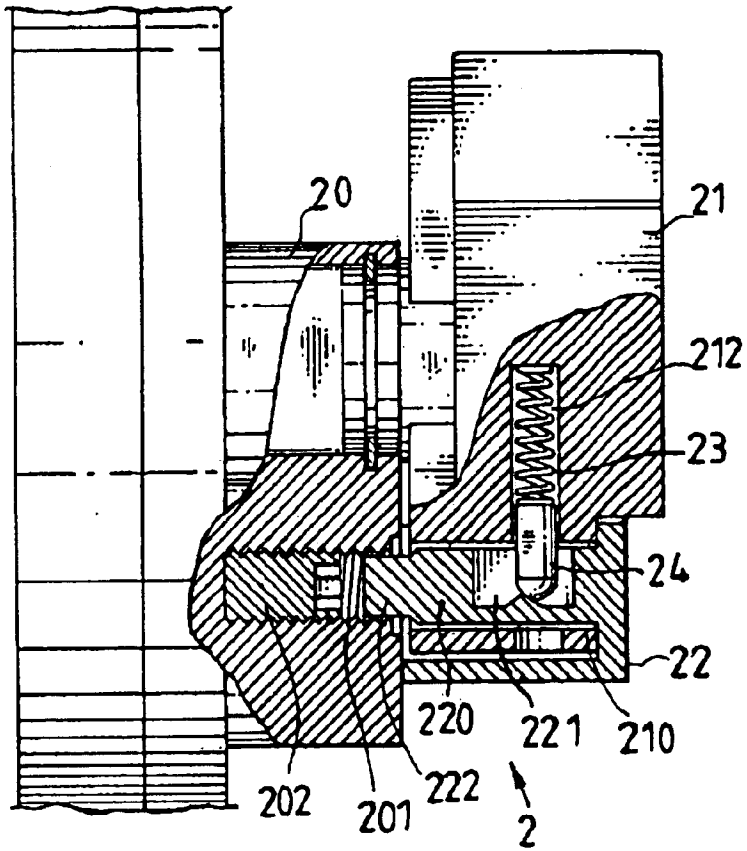
FIG. 9 is a schematic operational view of the secondary locking device as shown in FIG. 8.

As shown in FIGS. 8 and 9, when the locking stud 220 of the locking block 22 aligns with the locking hole 201 of the locking seat 20 by rotation of the control knob 21, the locking block 22 is pressed to move toward the locking seat 20, so that the locking stud 220 of the locking block 22 is locked in the locking hole 201 of the locking seat 20 to lock the control knob 21 on the locking seat 20 without rotation, such that the dead bolt 14 is fixed by the control member 215 of the control knob 21, thereby forming a secondary locking effect to achieve the anti-theft purpose. At this time, the positioning stub 24 is locked in one of the two spaced retaining grooves 221 of the locking stud 220 of the locking block 22, so that the locking block 22 is positioned by the positioning stub 24.

The secondary locking device 2 further includes a screw 202 rotatably mounted in the locking hole 201 of the locking seat 20 and having a length smaller than that of the locking hole 201 of the locking seat 20. When the screw 202 is moved to flush with a surface of the locking hole 201 of the locking seat 20, the locking stud 220 of the locking block 22 is stopped by the screw 202 and cannot be inserted into the locking hole 201 of the locking seat 20, thereby preventing the locking block 22 from being pressed inward by a child, and thereby preventing the dead bolt 14 and the control knob 21 from being locked unintentionally. In addition, the locking seat 20 has two sides each formed with an arcuate guide groove 203 located beside the locking hole 201 of the locking seat 20 to guide the locking stud 220 of the locking block 22.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A lock, comprising a quick unlocking device including:

a frame;

a face plate mounted on a side of the frame;

a drive shaft movably mounted in the frame;

a latch bolt retractably mounted on the face plate and secured on a first end of the drive shaft to move therewith;

a multi-stage dead bolt movably mounted in the frame and having a first end retractably mounted on the face plate and a second end having a first side formed with a plurality of arcuate locking grooves;

a locking plate movably mounted in the frame and having an end formed with a locking block detachably locked in either one of the locking grooves of the dead bolt to lock the dead bolt;

an inner crank pivotally mounted on the frame and having a first section secured on a second end of the drive shaft for moving the drive shaft and a second section formed with a pivot plate; and a hook plate movably mounted in the frame and having a first end pivotally mounted on the pivot plate of the inner crank and a second end formed with a hook portion located adjacent to the locking block of the locking plate, so that the hook portion of the hook plate is movable to urge and move the locking block of the locking plate to detach from the locking grooves of the dead bolt so as to release the dead bolt, such that the dead bolt is movable.

2. The lock in accordance with claim 1, wherein the inner crank is substantially L-shaped.

3. The lock in accordance with claim 1, wherein the inner crank has a mediate section formed with a square hole, and the quick unlocking device further includes an inner handle pivotally mounted on a door plate and having a square spindle secured in the square hole of the inner crank for rotating the inner crank, so that the inner crank is pivoted by rotation of the inner handle so as to move the drive shaft.

4. The lock in accordance with claim 1, wherein the quick unlocking device further includes an outer crank pivotally mounted on the frame and having a first section secured on the second end of the drive shaft for moving the drive shaft.

5. The lock in accordance with claim 1, wherein the quick unlocking device further includes a tensile spring having a first end secured on the frame and a second end secured on the second end of the hook plate, so that the hook portion of the hook plate is normally located under the locking block of the locking plate by the elastic force of the tensile spring.

6. The lock in accordance with claim 1, wherein the first end of the dead bolt is substantially U-shaped, and the quick unlocking device further includes a compression spring urged between the first end of the dead bolt and the face plate to push the dead bolt to move toward the locking plate to retract into the face plate.

7. The lock in accordance with claim 6, wherein the first end of the dead bolt has a mediate portion formed with a positioning post for mounting a first end of the compression spring, and the face plate is formed with a positioning post for mounting a second end of the compression spring.

8. The lock in accordance with claim 1, wherein when the inner crank is rotated, the latch bolt and the dead bolt are unlocked synchronously.

9. The lock in accordance with claim 1, wherein the hook plate has a mediate portion formed with a guide slot, and the quick unlocking device further includes a drive plate movably mounted in the frame and having a first end formed with a hook post slidably mounted in the guide slot of the hook plate and a second end formed with a screw bore, an adjusting bolt rotatably mounted on the face plate and screwed into the screw bore of the drive plate, and a positioning plate secured on the frame for retaining the adjusting bolt.

10. The lock in accordance with claim 9, wherein the face plate is formed with a through hole for receiving the adjusting bolt.

11. The lock in accordance with claim 1, further comprising a secondary locking device including:

a locking seat having an end formed with a locking hole;

a control knob rotatably mounted on the locking seat to control movement of the dead bolt and having an end formed with a slide seat that is rotatable with the control knob to align with the locking hole of the locking seat; and a locking block movably mounted on the slide seat of the control knob and having a hollow inside formed with a protruding locking stud detachably locked in the locking hole of the locking seat to lock the control knob on the locking seat.

12. The lock in accordance with claim 11, wherein the slide seat of the control knob has an inside formed with an axially extended rectangular insertion hole for insertion of the locking stud of the locking block.

13. The lock in accordance with claim 12, wherein the locking stud of the locking block is substantially rectangular and has a distal end formed with a cylindrical head detachably locked in the locking hole of the locking seat.

14. The lock in accordance with claim 11, wherein the locking stud of the locking block has a side formed with two spaced retaining grooves, the slide seat of the control knob has a periphery formed with a radially extended receiving recess extended into the control knob, and the secondary locking device further includes a positioning stub movably mounted in the receiving recess of the control knob and detachably locked in either one of the two spaced retaining grooves of the locking stud of the locking block to position the locking block, and a spring mounted in the receiving recess of the control knob and urged on the positioning stub to move toward the locking stud of the locking block.

15. The lock in accordance with claim 11, wherein the locking seat is formed with a mounting hole, and the control knob has a mediate portion formed with a protruding control member extended through the mounting hole of the locking seat and connected to the dead bolt, so that when the control knob is rotated, the dead bolt is moved by rotation of the control knob, and when the control knob is fixed, the dead bolt is fixed by the control member of the control knob without movement.

16. The lock in accordance with claim 11, wherein the secondary locking device further includes a screw rotatably mounted in the locking hole of the locking seat and having a length smaller than that of the locking hole of the locking seat.

17. The lock in accordance with claim 16, wherein the locking hole of the locking seat is threaded.

18. The lock in accordance with claim 16, wherein when the screw is moved to flush with a surface of the locking hole of the locking seat, the locking stud of the locking block is stopped by the screw.

19. The lock in accordance with claim 11, wherein the locking seat has two sides each formed with a guide groove located beside the locking hole of the locking seat to guide the locking stud of the locking block.

20. The lock in accordance with claim 19, wherein the guide groove is substantially arcuate.

* * * * *